US006664885B2

(12) United States Patent
Bromley et al.

(10) Patent No.: US 6,664,885 B2
(45) Date of Patent: Dec. 16, 2003

(54) THERMALLY ACTIVATED LATCH

(75) Inventors: Susan Bromley, Bloomington, MN (US); Karl Vollmers, Crystal, MN (US); Bradley J. Nelson, North Oaks, MN (US); Kamal Mothilal, Minneapolis, MN (US); Kevin Roberts, South St. Paul, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 09/944,714

(22) Filed: Aug. 31, 2001

(65) Prior Publication Data

US 2003/0048170 A1 Mar. 13, 2003

(51) Int. Cl.[7] ..... H01H 61/02; H01H 71/16

(52) U.S. Cl. ..... 337/104; 337/102; 337/85; 337/142; 60/528; 60/529; 60/523

(58) Field of Search ..... 337/361, 70, 75, 337/77, 85, 102, 104, 107, 111, 128, 139, 141, 142, 333, 356, 359, 379, 382, 385, 393, 401, 404, 405, 411; 60/516, 523, 527–529

(56) References Cited

U.S. PATENT DOCUMENTS

| | | | | | |
|---|---|---|---|---|---|
| 3,763,454 | A | * | 10/1973 | Zandonatti | 337/404 |
| 4,536,641 | A | * | 8/1985 | Chan | 219/253 |
| 5,084,691 | A | * | 1/1992 | Lester et al. | 337/297 |
| 5,192,937 | A | * | 3/1993 | Lee | 337/104 |
| 5,280,262 | A | * | 1/1994 | Fischer | 337/405 |
| 5,363,083 | A | * | 11/1994 | Fischer | 337/407 |
| 5,452,878 | A | * | 9/1995 | Gravesen et al. | 251/129.02 |
| 5,600,295 | A | * | 2/1997 | Kaufmann | 337/405 |
| 5,612,662 | A | * | 3/1997 | Drekmeier et al. | 337/389 |
| 5,770,993 | A | * | 6/1998 | Miyazawa et al. | 337/160 |
| 5,793,274 | A | * | 8/1998 | Kelly et al. | 337/183 |
| 5,896,080 | A | * | 4/1999 | Chen | 337/407 |
| 5,955,817 | A | | 9/1999 | Dhuler et al. | |
| 5,959,338 | A | | 9/1999 | Youngner et al. | |
| 5,962,949 | A | | 10/1999 | Dhuler et al. | |
| 5,979,892 | A | * | 11/1999 | Smith | 271/267 |
| 5,994,816 | A | | 11/1999 | Dhuler et al. | |
| 6,023,121 | A | | 2/2000 | Dhuler et al. | |
| 6,046,659 | A | * | 4/2000 | Loo et al. | 333/262 |
| 6,114,794 | A | | 9/2000 | Dhuler et al. | |
| 6,137,206 | A | | 10/2000 | Hill | |
| 6,184,699 | B1 | * | 2/2001 | Smith et al. | 324/762 |
| 6,348,851 | B1 | * | 2/2002 | Wyser et al. | 337/411 |
| 6,367,251 | B1 | * | 4/2002 | Wood | 60/528 |

FOREIGN PATENT DOCUMENTS

| | | | | |
|---|---|---|---|---|
| EP | 139301 | A2 | * 5/1985 | H01H/35/42 |

OTHER PUBLICATIONS

Han, H. et al., "Micromechanical Velcro", *Journal of Microelctromechanical Systems*, vol. 1, No. 1, pp. 37–43 (Mar. 1992).

Harsh, K. et al., "Solder Self–Assembly for MEMS", *Instrum. Aerosp. Inc. Proc. Int. Symp.*, vol. 44, pp. 249–255 (1998).

* cited by examiner

*Primary Examiner*—Anatoly Vortman
(74) *Attorney, Agent, or Firm*—Merchant & Gould P.C.

(57) ABSTRACT

A device is described for latching an actuator to a substrate where the substrate includes a thermally activated material located on the substrate and a heater capable of heating the thermally activated material until it softens. The actuator includes a contact area that is spaced above the thermally activated material in a non-contact position. The actuator is movable from the non-contact position to a contact position where the contact area contacts the thermally activated material of the substrate. A method of latching actuator is also provided including heating the thermally activated material until it softens and moving an actuator into the contact position.

25 Claims, 3 Drawing Sheets

THERMALLY ACTIVATED LATCH

FIELD OF THE INVENTION

The invention is directed to a microelectromechanical device and a method for latching a device, more particularly to a device having a component that can be latched and remains latched in an unpowered state.

BACKGROUND OF THE INVENTION

Microelectromechanical systems (MEMS) have recently been developed as alternatives for conventional electromechanical devices such as relays, actuators, valves and sensors. MEMS relays having lower contact-to-contact resistance are needed. In addition, it is advantageous to have a relay that does not require power to maintain the relay in a latched position, but merely uses power to actuate the relay between the positions.

SUMMARY OF THE INVENTION

Generally, the present invention provides a device for latching an actuator to a substrate where the substrate includes a thermally activated material located on the substrate. The device also includes a heater coupled to the thermally activated material that is capable of heating the thermally activated material until it softens. The actuator includes a contact area and the actuator is movable between a contact position and a non-contact position. In the non-contact position, the contact area is spaced apart from the thermally activated material on the substrate. In the contact position, the actuator contacts the thermally activated material at the contact area.

A method of latching the actuator on a device is also provided including the steps of heating a thermally activated material until it softens. A next step is moving an actuator having a contact area from a non-contact position to a contact position where the contact area is in contact with the softened thermally activated material. The thermally activated material is allowed to cool and resolidify so that the thermally activated material retains the actuator in the contact position.

BRIEF DESCRIPTION OF THE DRAWINGS

The invention may be more completely understood by considering the detailed description of various embodiments of the invention which follows in connection with the accompanying drawings.

Figure 1:
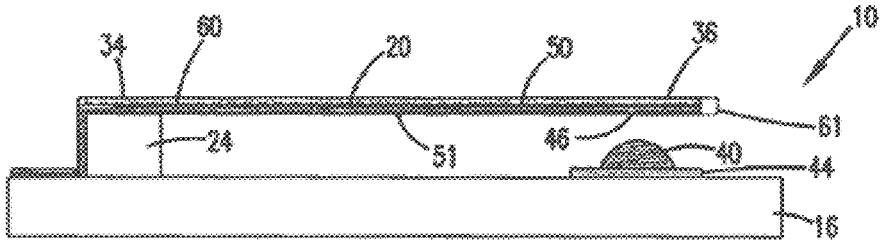
FIG. 1 is a side view of one embodiment of a microelectromechanical system (MEMS) device, shown in an OFF or non-contact position.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE EMBODIMENTS

The invention is believed to be applicable to a variety of systems and arrangements for microelectromechanical system (MEMS) devices. The invention has been found to be particularly advantageous in application environments where an actuator is needed, such as in telecommunications. While the invention is not so limited, an appreciation of various aspects of the invention is best gained through a discussion of various application examples operating in such an environment.

Figure 2:
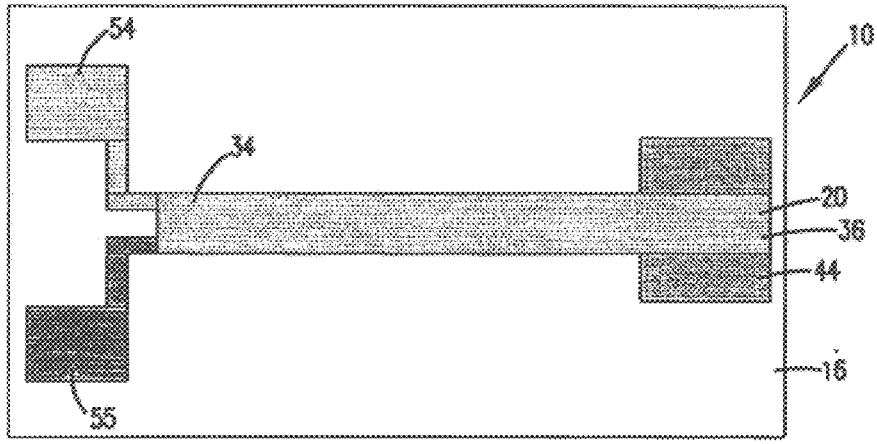
FIG. 2 is a top view of the device of FIG. 1.
Figure 3:
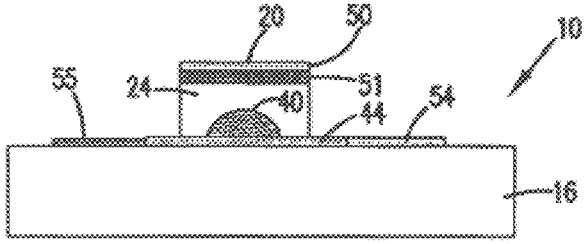
FIG. 3 is a front view of the device of FIG. 1 in the non-contact position.

FIG. 1 illustrates a side view of one particular embodiment of a MEMS device 10. FIG. 2 illustrates a top view of device 10 and FIG. 3 illustrates a front view of device 10. The device 10 includes a substrate 16, an actuator 20 and a spacer or anchor 24 between the substrate 16 and the actuator 20. The actuator 20 is fixed to the spacer 24 at a first end 34 and is spaced from and suspended over the substrate 16 at a second end 36 in a non-contact position illustrated in FIG. 1. The substrate 16 includes a thermally activated material 40 and a heating element 44 positioned underneath the second end 36 of the actuator 20. The second end 36 of the actuator 20 includes a contact area 46 (shown in FIG. 1) that will contact the thermally activated material when the actuator 20 is in a contact position.

Figure 4:
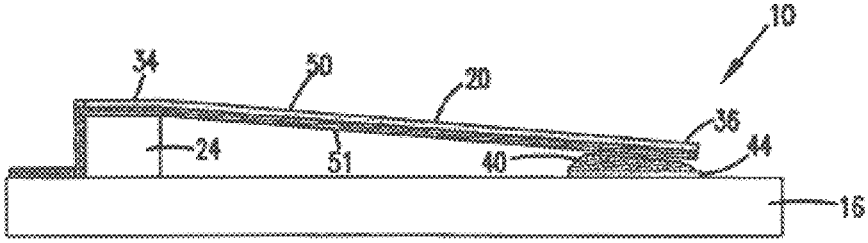
FIG. 4 is a side view of the device of FIG. 1 in an ON or contact position.

The actuator 20 is movable between the non-contact position illustrated in FIG. 1 and a contact position illustrated in FIG. 4. In the contact position, the actuator 20 contacts the substrate at the contact area 46 at its second end 36. The thermally activated material 40 is used to hold the actuator in the contact position. To accomplish this latching, the thermally activated material 40 is heated by the heating element 44 until it at least softens. Often, the material 40 softens at a melting point, but some materials have a softening point that is lower than the melting point, as discussed further herein. The thermally activated material should be softened sufficiently so that the actuator can establish good contact with the thermally activated material over a significant area. The actuator 20 is then brought into contact with the softened thermally activated material 40. The heating element 44 is turned off and the thermally activated material 40 is allowed to cool to a temperature below the melting temperature, which causes the contact area 46 of the actuator 20 to be fused to the material 40. The thermally activated material 40 retains the actuator in place as it stiffens and holds the actuator to the substrate. Thus no power is needed to keep the actuator in a latched position. To move the actuator 20 from the contact position to the non-contact position, the thermally activated material 40 is heated, softens, and releases the actuator 20. In one preferred embodiment, the actuator 20 has a spring force that returns it to its noncontact position when the thermally activated material 40 is softened. In alternate embodiments, other actuating mechanisms are used to move the actuator 20 to the noncontact position, such as thermal, mechanical, electrostatic, magnetic, electromagnetic or other mechanisms.

The thermally activated material 40 may include many different materials that are softened at a temperature that is achievable by the device and is compatible with the use of the device. A softening temperature that is as low as possible is preferred because it requires less power to heat the thermally activated material. Other characteristics of the thermally activated material 40 should also be considered when selecting a material, such as the heat of melting transformation, the viscosity and any vapor release that will occur during heating or melting. Preferably, the thermally activated material will not run off of the substrate 16 when heated to the point where it softens. The thermally activated material may include additives to prevent it from running off of the substrate when heated.

For many choices for the thermally activated material, such as solder materials, the material softens at its melting point. Other materials may have a softening point that is lower than its melting point. Some materials have a softening temperature range over which they become increasingly pliant. The thermally activated material will be heated to a point where it is soft enough to allow the contact area of the actuator to establish good surface area contact with it, so that the actuator will be held in place when the thermally activated material cools. This point may be at the softening point, at the melting point, or somewhat beyond the softening point depending on the material.

Examples of materials that can be used as the thermally activated material are described in RAGNAR HOLM, ELECTRIC CONTACTS (4th ed. 1967), which is hereby incorporated herein by reference in its entirety. Table X,1 of ELECTRIC CONTACTS provides melting temperatures and softening temperatures where appropriate for several materials that could be used for a thermally activated material, such as gold or copper.

Where the thermally activated material softens at its melting temperature, a preferred range for a melting temperature of the thermally activated material is about 250° C. (482° F.) or less, more preferably about 220° C. (420° F.) or less, still more preferably about 190° C. (374° F.) or less, and most preferably about 160° C. (320° F.) or less. One example of such a thermally activated material 44 is solder. Solder is an alloy of tin, lead and bismuth that enables a melting temperature as low as 135° C. (275° F.). Solder may include flux to prevent the solder from running off of the substrate when heated. The following Chart 1 shows material composition and melting temperatures for three common solder types.

CHART 1

Melting Temperatures for Common Solder Type

| Solder Type | % Lead | % Tin | Melting Temp. (° C.) | Melting Temp. (° F.) |
|---|---|---|---|---|
| 50–50 | 50 | 50 | 218 | 425 |
| 60–40 | 60 | 40 | 188 | 371 |
| 63–37 | 63 | 37 | 183 | 361 |

The actuator 20 may be moved between the contact position and non-contact position in many different ways. For example, in the first embodiment illustrated in FIGS. 1–4, the actuator 20 is a bi-material cantilever arm including a first material 50 and a second material 51, shown in FIG. 1. The materials have different coefficients of thermal expansion causing each material to expand differently when heated, so that the actuator moves into the contact position shown in FIG. 4. The first material 50 is connected to a first heating element 54 and the second material 51 is connected to a second heating element 55, shown in FIG. 2. In an alternate embodiment only one heating element is used to heat the actuator 20. In yet another alternate embodiment, a current source is coupled to the actuator to heat the actuator 20. An actuator heated by current may include two layers separated by an insulating material 60 along most of its length, but with a conductive bridge 61 between the layers at the end 36. A current source could be applied to the actuator to heat the actuator. In this alternative, the dimensions and resistance of the actuator components are selected so that sufficient heat to move the actuator is generated by the application of current. The actuator 20 may be configured so that a restoring force acts to restore it back to the non-contact position from the contact position.

Many different configurations for a bi-material cantilever are possible. In addition, other types of thermally activated actuators are possible. Other alternative actuating mechanisms are also possible. For example, electrostatic, magnetic, electromagnetic, mechanical or other forces may be used to move the actuator 20 between the contact and non-contact positions.

Figure 5:
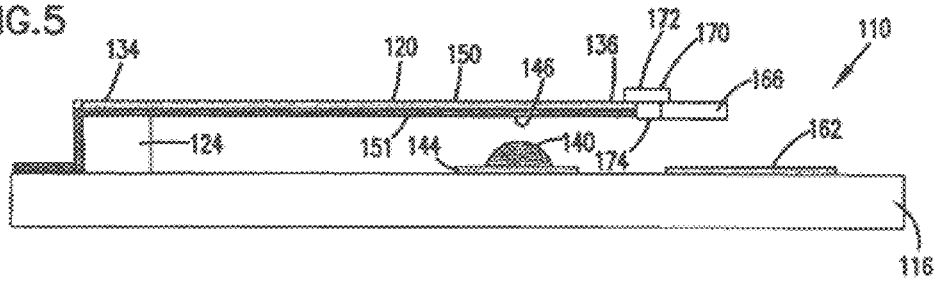
FIG. 5 is a side view of a second embodiment of a MEMS device, shown in an OFF or non-contact position.
Figure 6:
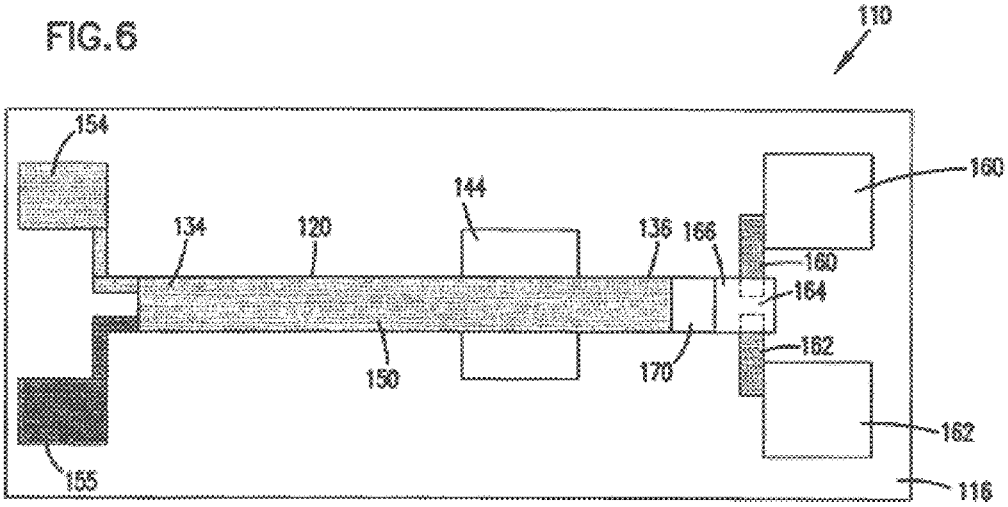
FIG. 6 is a top view of the MEMS device of FIG. 5.
Figure 7:
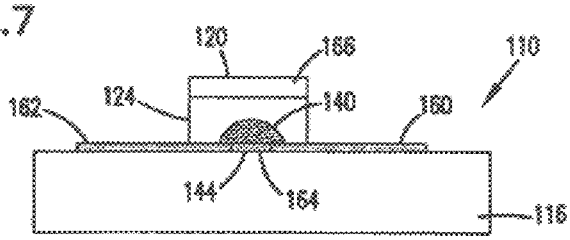
FIG. 7 is a front view of the device of FIG. 5 in the non-contact position.

A MEMS device 100 is shown in FIGS. 5–7 that is similar in many ways to the device 10 shown in FIGS. 1–4. The device 100 of FIGS. 5–7 includes a substrate 116, an actuator 120 and a spacer 124 between the substrate 116 and a first end 134 of the actuator 120. A second end 136 of the actuator 120 is spaced away from the substrate 116. The substrate 116 includes a thermally activated material 140 and a heating element 144. The actuator 120 is movable between a non-contact position illustrated in FIG. 5 and a contact position where the actuator 120 is touching the thermally activated material 140. The actuator 120 includes a contact area 146 that will contact the thermally activated material 140 when the actuator 120 is in a contact position. The contact position for actuator 120 is similar to the contact position of the actuator 20 shown in FIG. 4.

The actuator 120 may be a bi-material cantilever beam including a first material 150 and second material 151, shown in FIG. 5, where the first and second materials 150, 151 are connected to first and second heating elements 154, 155. The actuator 120 may operate like the embodiment of FIGS. 1–4 having a bi-material cantilever, as described above. The alternative actuating mechanisms for the actuator 120 that were described above are also available for the embodiment of FIGS. 5–7.

The device 100 also includes an input line 160 and an output line 162, separated by a gap 164, shown in FIGS. 6–7. The actuator 120 includes a crossbar 166 at a second end 136 of the actuator 120. When the actuator 120 is in a contact position, similar to the contact position illustrated in FIG. 4, the crossbar 166 contacts both the input and output lines 160, 162, bridging the gap 164. The crossbar 166 is an electrically conductive material that completes a microrelay between the input and output signal lines 160, 162.

Preferably, the actuator 120 also includes a connector device 170 joining the crossbar to the remainder of the actuator 120. In a preferred embodiment, the connector device 170 is somewhat flexible, so that it is possible for the crossbar 166 to be held flush against the input and output lines 160, 162 although the remainder of the actuator 120 is not horizontally orientated. This will allow the contact area between the crossbar 166 and the input and output lines 160, 162 to be as large as possible.

The connector device 170 includes a top piece 172 and a bottom piece 174, shown in FIG. 5. The connector device 170 can function without the top piece 172. The connector device 172 may have many different configurations than the configuration illustrated in FIG. 5 as long as the connector device 170 allows the crossbar 166 to contact the input line 160 and output line 162 when the actuator 20 is in the contact position. Where current is applied to the actuator to move the actuator, connector device 170 is preferably an electrical insulator.

Figure 8:
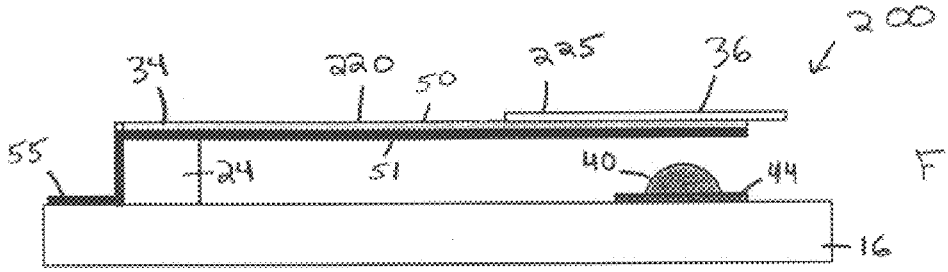
FIG. 8 is a side view of a third embodiment of a MEMS device in an OFF or non-contact position.
Figure 9:
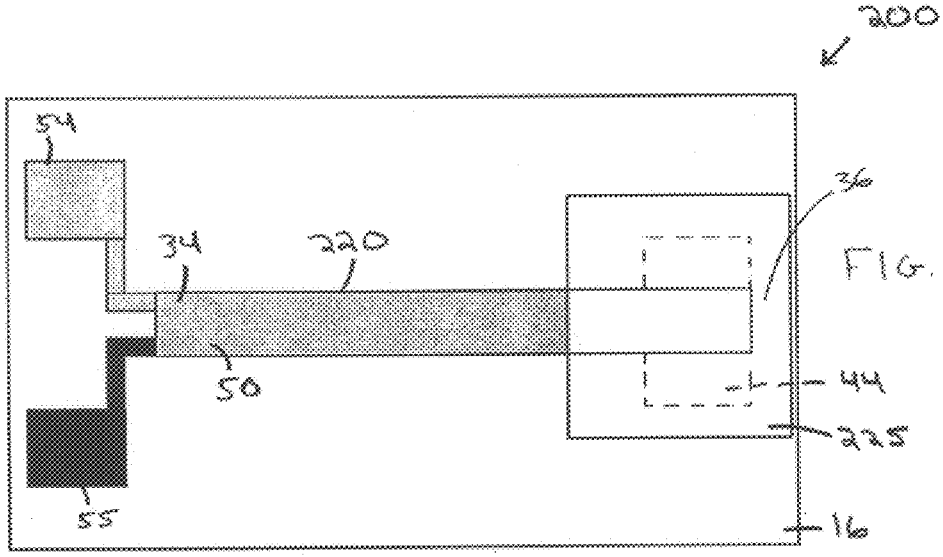
FIG. 9 is a top view of the MEMS device of FIG. 8.
Figure 10:
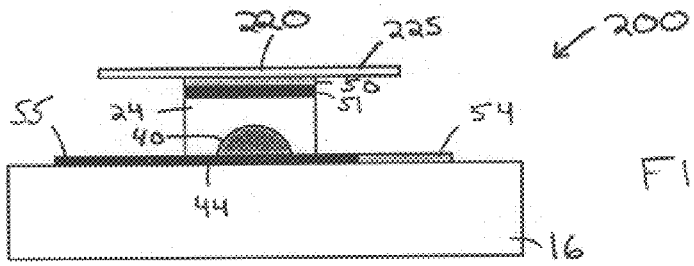
FIG. 10 is a front view of the device of FIG. 8 in the non-contact position.

The MEMS device 200 illustrated in FIGS. 8–10 includes a substrate 16, an actuator 220, and a spacer 24 between the actuator 220 and the substrate 16. Many elements of the device 200 are the same as the elements of the device 10 shown in FIGS. 1–4, and like reference numbers are used to refer to these elements. The actuator 220 can move between a non-contact position shown in FIGS. 8–10 and a contact position similar to that illustrated in FIG. 4. In addition to the elements described in relation to FIGS. 1–4, the device 200 shown in FIGS. 8–10 includes a mirror 225 at a second end 36 of the actuator 20. The movement of the mirror 225 along with the actuator 220 allows the device 200 to be used as a switch or relay in an optical device.

The devices described herein are preferably fabricated using batch processing techniques for advantages in cost and ease of assembly.

The various embodiments described above are provided by way of illustration only and should not be construed to limit the invention. Those skilled in the art will readily recognize various modifications and changes which may be made to the present invention without strictly following the exemplary embodiments and applications illustrated and described herein, and without departing from the true spirit and scope of the present invention which is set forth in the following claims.

What is claimed is:

1. A microelectromechanical device for latching an actuator to a substrate, comprising:

a substrate comprising a thermally activated material located on the substrate;

a heater coupled to the thermally activated material and capable of heating the thermally-activated material until it softens; and an actuator including:

i) an actuating mechanism having a contact area, the actuating mechanism including a first member comprising a first material having a first coefficient of thermal expansion, and a second member comprising a second material having a second different coefficient of thermal expansion;

ii) a first heating element arranged in thermal communication with the first member;

iii) a second heating element arranged in thermal communication with the second member;

wherein the first and second members have different expansion characteristics arranged to permit the actuator to move between a contact position and a non-contact position, wherein the contact area of the actuator is in contact with the thermally activated material of the substrate in the contact position, and wherein the contact area is spaced apart from the thermally activated material in the non-contact position.

2. The device of claim 1 wherein the thermally activated material is capable of retaining the actuator in the contact position after softening and resolidifying.

3. The device of claim 1 wherein the thermally activated material is a solder material.

4. The device of claim 1 wherein the thermally activated material comprises one of the group consisting of tin, lead and bismuth.

5. The device of claim 1 wherein the actuator is in a deflected position in the contact position and a restoring force acts to return the actuator to the non-contact position from the contact position.

6. The device of claim 1 wherein the actuator further comprises a mirror.

7. The device of claim 1 wherein the substrate further comprises two signal lines separated by a gap, wherein the actuator further comprises a conductive material and wherein the conductive material of the actuator bridges the gap between the signal lines when the actuator is in the contact position.

8. A method of latching an actuator on a microelectromechanical device, the method comprising the steps of:

heating a thermally activated material until it is softened;

moving an actuator having a contact area from a non-contact position, where the contact area is spaced apart from the thermally activated material, to a contact position, where the contact area is in contact with the softened thermally activated material;

contacting a first signal line and a second signal line with an actuator end piece positioned at a free end of the actuator to provide electrical communication between the first and second signal lines when the actuator moves to the contact position, and allowing the thermally activated material to cool so that the thermally activated material retains the actuator in the contact position.

9. The method of claim 8 wherein moving the actuator from the non-contact position to the contact position comprises heating the actuator.

10. The method of claim 8 wherein the actuator is in a deflected position in the contact position and wherein a restoring force acts to move the actuator from the contact position to the non-contact position, further comprising the steps of:

heating the thermally activated material so that it softens; and allowing the restoring force to return the actuator to the non-contact position.

11. The method of claim 8 further comprising the steps of:

heating the thermally activated material so that it softens; and moving the actuator to the non-contact position.

12. A microelectromechanical device, comprising:

a substrate comprising a thermally activated material and two signal lines separated by a gap, the thermally activated material being located on the substrate;

a heating device coupled to the thermally activated material and capable of heating the thermally-activated material so that it softens; and an actuator comprising a contact area and a conductive material end piece, the conductive material end piece being configured to provide electrical communications between the two signal lines, wherein the actuator is movable between a contact position and a non-contact position, wherein the contact area of the actuator is in contact with the thermally activated material of the substrate, and the end piece is in contact with each of the two signal lines in the contact position, and wherein the contact area is spaced apart from the thermally activated material, and the end piece is spaced apart from each of the two signal lines in the non-contact position.

13. The device of claim 12 wherein the thermally activated material is capable of retaining the actuator in the contact position after softening and resolidifying.

14. The device of claim 12 wherein the actuator further comprises an actuating mechanism for moving the actuator between the contact position and the non-contact position.

15. The device of claim 12 wherein the actuating mechanism comprises a heating element and the actuator further comprises two materials having different coefficients of thermal expansion.

16. The device of claim 12 wherein the actuator further comprises a mirror.

17. The device of claim 12 wherein the conductive material end piece is positioned at a free end of the actuator, the actuator further including a connector positioned between the conductive material end piece at the free end and the contact area.

18. The device of claim 17 wherein the connector is flexible connector configured to flex such that the a surface of the conductive material end piece is positioned flush against each of the two signal lines to provided an enlarged surface area contact between the conductive material end piece and the two signal lines when the actuator is in the contact position.

19. A microelectromechanical device for latching an actuator to a substrate, comprising:

a substrate comprising a thermally activated material located on the substrate;

a heater coupled to the thermally activated material and capable of heating the thermally-activated material until it softens; and an actuator including:

i) a first actuator member comprising a first material;

ii) a first heating element arranged in thermal communication with the first actuator member;

iii) a second actuator member comprising a second material different than the first material;

iv) a second heating element arranged in thermal communication with the second actuator member;

wherein the actuator moves from a non-contact position to a contact position when one of the first and second actuator members is heated, wherein the contact area of the actuator is in contact with the thermally activated material of the substrate in the contact position, and wherein the contact area is spaced apart from the thermally activated material in the non-contact position.

20. The device of claim 19 wherein the thermally activated material is capable of retaining the actuator in the contact position after softening and resolidifying.

21. The device of claim 19 wherein the actuator is in a deflected position in the contact position and a restoring force acts to return the actuator to the non-contact position from the contact position.

22. A microelectromechanical device for latching an actuator to a substrate, comprising:

a substrate;

a thermally activated material positioned on the substrate;

a heater configured to heat the thermally-activated material; and an actuator movable between a contact position and a non-contact position, the actuator including:

i) a first arm including a first material having a first coefficient of thermal expansion;

ii) a second arm including a second material having a second coefficient of thermal expansion;

iii) an insulating layer positioned between the first arm and the second arm; and iv) a contact area positioned to contact the thermally activated material of the substrate when the actuator is in a contact position.

23. The device of claim 22, further including a conductive piece positioned at free ends of each of the first and second arms, the conductive piece being configured to provide electrical communication between the first arm and the second arm.

24. The device of claim 23, wherein the conductive piece is configured to conduct a current from the first arm to the second arm.

25. The device of claim 22, wherein each of the first and second arms has a length, the insulating layer extending along a majority of the length of the first and second arms.

* * * * *

UNITED STATES PATENT AND TRADEMARK OFFICE

CERTIFICATE OF CORRECTION

PATENT NO. : 6,664,885 B2
DATED : December 16, 2003
INVENTOR(S) : Bromley et al.

It is certified that error appears in the above-identified patent and that said Letters Patent is hereby corrected as shown below:

Column 5,
Line 44, after "softens; and" please place a line break.

Signed and Sealed this

Fifteenth Day of June, 2004

JON W. DUDAS
*Acting Director of the United States Patent and Trademark Office*